US012577893B2

(12) United States Patent
Císař

(10) Patent No.: US 12,577,893 B2
(45) Date of Patent: Mar. 17, 2026

(54) DOUBLE PRESSURE CAPSULE ASSEMBLY

(71) Applicant: EATON INTELLIGENT POWER LIMITED, Dublin (IE)

(72) Inventor: Ondřej Císař, Dvur Kralove nad Labem (CZ)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 18/851,317

(22) PCT Filed: Mar. 28, 2023

(86) PCT No.: PCT/EP2023/025139
§ 371 (c)(1),
(2) Date: Sep. 26, 2024

(87) PCT Pub. No.: WO2023/186349
PCT Pub. Date: Oct. 5, 2023

(65) Prior Publication Data

US 2025/0172075 A1 May 29, 2025

Related U.S. Application Data

(60) Provisional application No. 63/362,032, filed on Mar. 28, 2022.

(51) Int. Cl.
*F01L 1/26* (2006.01)
*F01L 13/06* (2006.01)

(52) U.S. Cl.
CPC ..... *F01L 1/267* (2013.01); *F01L 13/065* (2013.01)

(58) Field of Classification Search
CPC ..... F01L 1/181; F01L 13/065; F01L 1/267; F01L 13/06; F01L 1/2411; F01L 1/2416
See application file for complete search history.

(56) References Cited

U.S. PATENT DOCUMENTS

| | | | | |
|---|---|---|---|---|
| 10,240,490 | B2 | 3/2019 | Nielsen | |
| 10,794,235 | B1 * | 10/2020 | Erickson | F01L 1/2416 |
| 10,823,018 | B1 * | 11/2020 | Berndt | F01L 13/06 |
| 11,060,427 | B2 * | 7/2021 | Berndt | F01L 13/06 |

(Continued)

OTHER PUBLICATIONS

International Search Report and Written Opinion for PCT/EP2023/025139 dated Oct. 13, 2023, 9 pages.

*Primary Examiner* — J. T. Newton
(74) *Attorney, Agent, or Firm* — Meunier Carlin & Curfman LLC

(57) ABSTRACT

A double pressure capsule assembly for actuating a valve. The capsule assembly includes a plunger movable between a deactivated position wherein the plunger is disengaged from the valve and an activated position wherein the plunger engages the valve. The plunger divides the housing into a first chamber connected to a first source of fluid at a first pressure and a second chamber selectively connected to a second source of fluid at the first pressure. The plunger has a first surface area bordering the first chamber and a second surface area bordering the second chamber. The first surface area is less than the second surface area. A check valve divides the second chamber into a first sub-chamber and a second sub-chamber. A piston is disposed in the second chamber and is movable to engage the check valve and move the check valve to the open position.

20 Claims, 11 Drawing Sheets

(56) References Cited

U.S. PATENT DOCUMENTS

| | | | | |
|---|---|---|---|---|
| 11,339,690 | B2 * | 5/2022 | Vanwingerden | F01L 1/46 |
| 12,270,323 | B2 * | 4/2025 | Andrisani | F01L 13/06 |
| 2017/0175597 | A1 * | 6/2017 | Cecur | F01L 1/2416 |
| 2018/0073401 | A1 | 3/2018 | Andrisani | |
| 2019/0010835 | A1 * | 1/2019 | McCarthy, Jr. | F01L 1/267 |
| 2019/0040769 | A1 * | 2/2019 | Nielsen | F01L 13/065 |
| 2020/0131946 | A1 * | 4/2020 | Persson | F01L 1/18 |
| 2021/0108542 | A1 | 4/2021 | Grynberg | |
| 2021/0131318 | A1 | 5/2021 | Vanwingerden | |
| 2023/0016116 | A1 * | 1/2023 | Lahr | F01L 13/06 |
| 2024/0263569 | A1 * | 8/2024 | Andrisani | F01L 1/181 |
| 2024/0384670 | A1 * | 11/2024 | Andrisani | F01L 13/065 |
| 2025/0101891 | A1 * | 3/2025 | Andrisani | F01L 13/065 |
| 2025/0172075 | A1 * | 5/2025 | Císar | F01L 13/065 |

* cited by examiner

DOUBLE PRESSURE CAPSULE ASSEMBLY

PRIORITY

This application claims the benefit of priority of U.S. provisional patent application Ser. No. 63/362,032, filed Mar. 28, 2022, the contents of which are incorporated herein by reference in their entirety.

FIELD

The subject application relates to, in general, a mechanism for variable valve actuation (VVA). More particularly, this application relates to a double pressure capsule that provides for variable valve actuation.

BACKGROUND

Many internal combustion engines utilize variable valve actuation (VVA), for example, for compression release brake or late intake valve closing.

There is a need for a VVA system that has a low impact on energy consumption.

SUMMARY OF THE INVENTION

There is provided a double pressure capsule assembly for selectively actuating a valve. The capsule assembly includes a plunger movable within a body between a deactivated position wherein the plunger is disengaged from the valve and an activated position wherein the plunger engages the valve. The plunger divides the housing into a first chamber fluidly connected to a first source of fluid at a first pressure and a second chamber selectively connected to a second source of fluid at the first pressure. The plunger has a first surface area bordering the first chamber and a second surface area bordering the second chamber. The first surface area is less than the second surface area. A check valve is disposed within the second chamber for selectively dividing the second chamber into a first sub-chamber and a second sub-chamber. The check valve has an open position wherein the first sub-chamber and the second sub-chamber are fluidly connected to each other and a closed position wherein the first sub-chamber and the second sub-chamber are fluidly isolated from each other. A piston is disposed in the second chamber. The piston is movable between a first position wherein the piston engages the check valve and moves the check valve to the open position and a second position wherein the piston is disengaged from the check valve.

In the foregoing double pressure capsule assembly, the body is a housing that is insertable into a rocker arm.

In the foregoing double pressure capsule assembly, the housing is threaded into the rocker arm.

In the foregoing double pressure capsule assembly, the housing includes an inner wall between the first sub-chamber and the second sub-chamber. The check valve is configured to selective close a hole extending through the inner wall.

In the foregoing double pressure capsule assembly, the body includes first holes for fluidly connecting the first chamber to the first source of fluid and second holes for fluidly connecting the second chamber to the second source of fluid.

In the foregoing double pressure capsule assembly, the check valve includes a ball that selectively engages a hole fluidly connecting the first sub-chamber and the second sub-chamber. The closed position of the check valve corresponds to the ball closing the hole and the open position of the check valve corresponds to the ball being spaced from the hole.

In the foregoing double pressure capsule assembly, a spring for biases the ball into engagement with the hole.

In the foregoing double pressure capsule assembly, a holder receives the ball and the spring wherein the spring is compressed between the holder and the ball.

In the foregoing double pressure capsule assembly, the hole is formed in a wall that borders both the first sub-chamber and the second sub-chamber.

In the foregoing double pressure capsule assembly, a spring biases the piston to the first position.

In the foregoing double pressure capsule assembly, a seal element closes an open end of the body, wherein a portion of the plunger extends through the seal element to a surrounding environment.

In the foregoing double pressure capsule assembly, the piston includes a stem configured to engage the check valve.

In the foregoing double pressure capsule assembly, the double pressure capsule assembly is disposed in a rocker arm and the first chamber is fluidly connected to the first source of fluid via a first lubrication channel that extends through the rocker arm between a shaft and the first chamber and the second chamber is fluidly connected to the second source of fluid via a second lubrication channel that extends through the rocker arm between the shaft and the second chamber.

There is further provided a double pressure capsule assembly for selectively actuating a valve. The capsule assembly includes a housing removably inserted into a rocker arm. The housing defines an inner cavity extending axially therethrough. A first hole extends through a wall of the housing to fluidly connect the inner cavity to a surrounding environment and a second hole extends through the wall of the housing to fluidly connect the inner cavity to the surrounding environment. The first hole is spaced from the second hole. A plunger is movable within the housing between a deactivated position wherein the plunger is disengaged from the valve and an activated position wherein the plunger engages the valve. The plunger divides the housing into a first chamber fluidly connected to a first source of fluid at a first pressure via the first hole and a second chamber selectively connected to a second source of fluid at the first pressure via the second hole. The plunger has a first surface area bordering the first chamber and a second surface area bordering the second chamber, wherein the first surface area is less than the second surface area. A check valve is disposed within the second chamber for selectively dividing the second chamber into a first sub-chamber and a second sub-chamber. The check valve has an open position wherein the first sub-chamber and the second sub-chamber are fluidly connected to each other and a closed position wherein the first sub-chamber and the second sub-chamber are fluidly isolated from each other. The second hole fluidly connects the first sub-chamber to the surrounding environment. A piston is disposed in the second chamber. The piston is movable between a first position wherein the piston engages the check valve and moves the check valve to the open position and a second position wherein the piston is disengaged from the check valve.

In the foregoing double pressure capsule assembly, the housing is threaded into the rocker arm.

In the foregoing double pressure capsule assembly, the housing includes an inner wall between the first sub-chamber and the second sub-chamber. The check valve is configured to selective close a hole extending through the inner wall.

In the foregoing double pressure capsule assembly, the check valve includes a ball that selectively engages a hole fluidly connecting the first sub-chamber and the second sub-chamber. The closed position of the check valve corresponds to the ball closing the hole and the open position of the check valve corresponds to the ball being spaced from the hole.

In the foregoing double pressure capsule assembly, a spring for biases the ball into engagement with the hole.

In the foregoing double pressure capsule assembly, a holder receives the ball and the spring wherein the spring is compressed between the holder and the ball.

In the foregoing double pressure capsule assembly, a spring biases the piston to the first position.

In the foregoing double pressure capsule assembly, a seal element closes an open end of the housing, wherein a portion of the plunger extends through the seal element to the surrounding environment.

In the foregoing pressure capsule assembly, the first chamber is fluidly connected to the first source of fluid via a first lubrication channel that extends through the rocker arm between a shaft and the first chamber and the second chamber is fluidly connected to the second source of fluid via a second lubrication channel that extends through the rocker arm between the shaft and the second chamber.

DETAILED DESCRIPTION

The following presents a description of the disclosure; however, aspects may be embodied in many different forms and should not be construed as limited to the embodiments set forth herein. Furthermore, the following examples may be provided alone or in combination with one or any combination of the examples discussed herein. Directional references such as "left" and "right" are for ease of reference to the figures.

Figure 1:
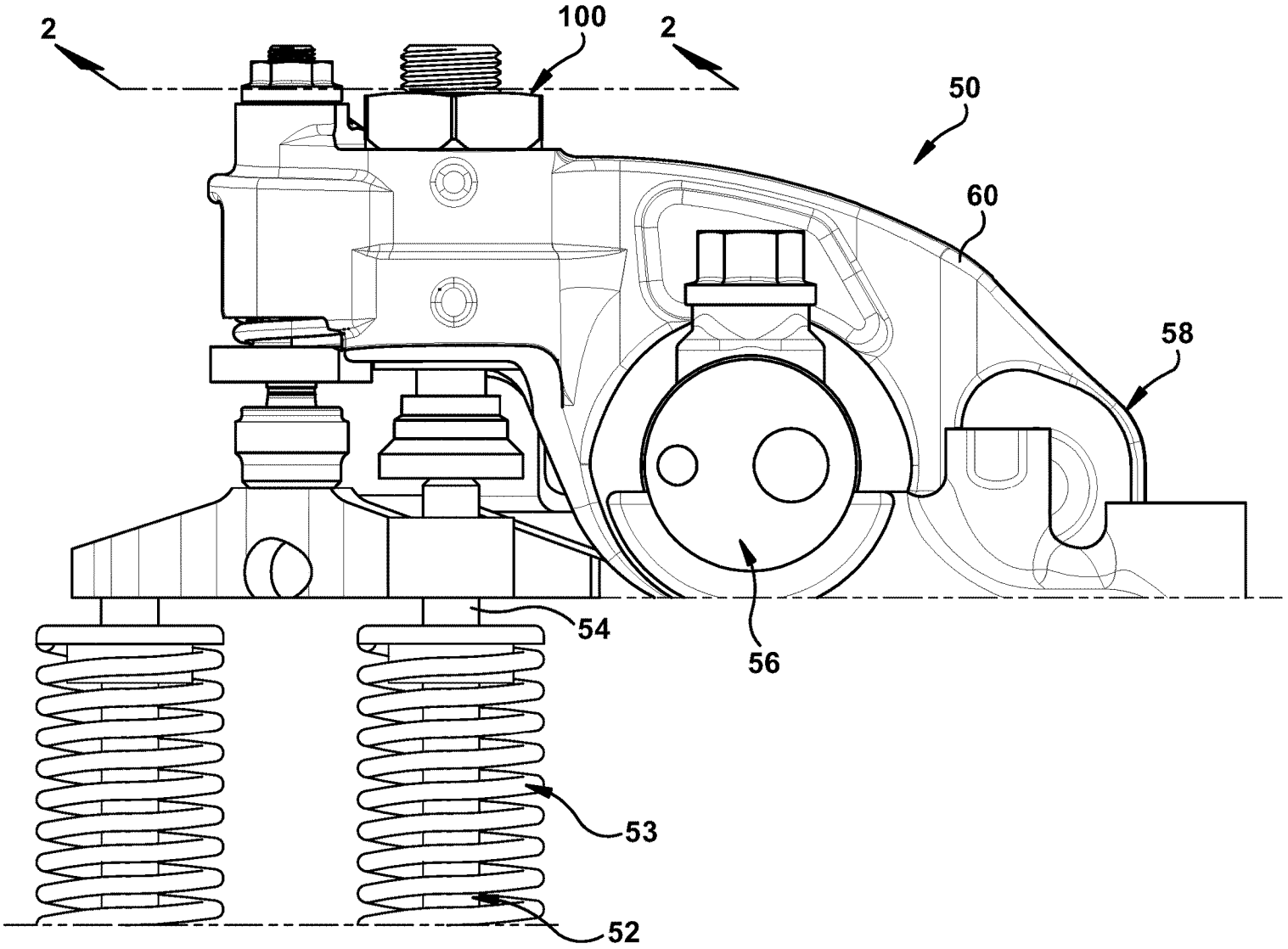
FIG. 1 is a side view of a rocker arm assembly.

Referring to FIG. 1, the rocker arm assembly 50 includes a rocker arm 60 and double pressure capsule assembly 100. The double pressure capsule assembly 100 is positioned to selectively engage a distal end 54 of a valve 52 to move the valve 52. In the embodiment illustrated, the rocker arm 60 is pivotable about a shaft 56 via actuation at a roller end 58 of the rocker arm 60.

Figure 2:
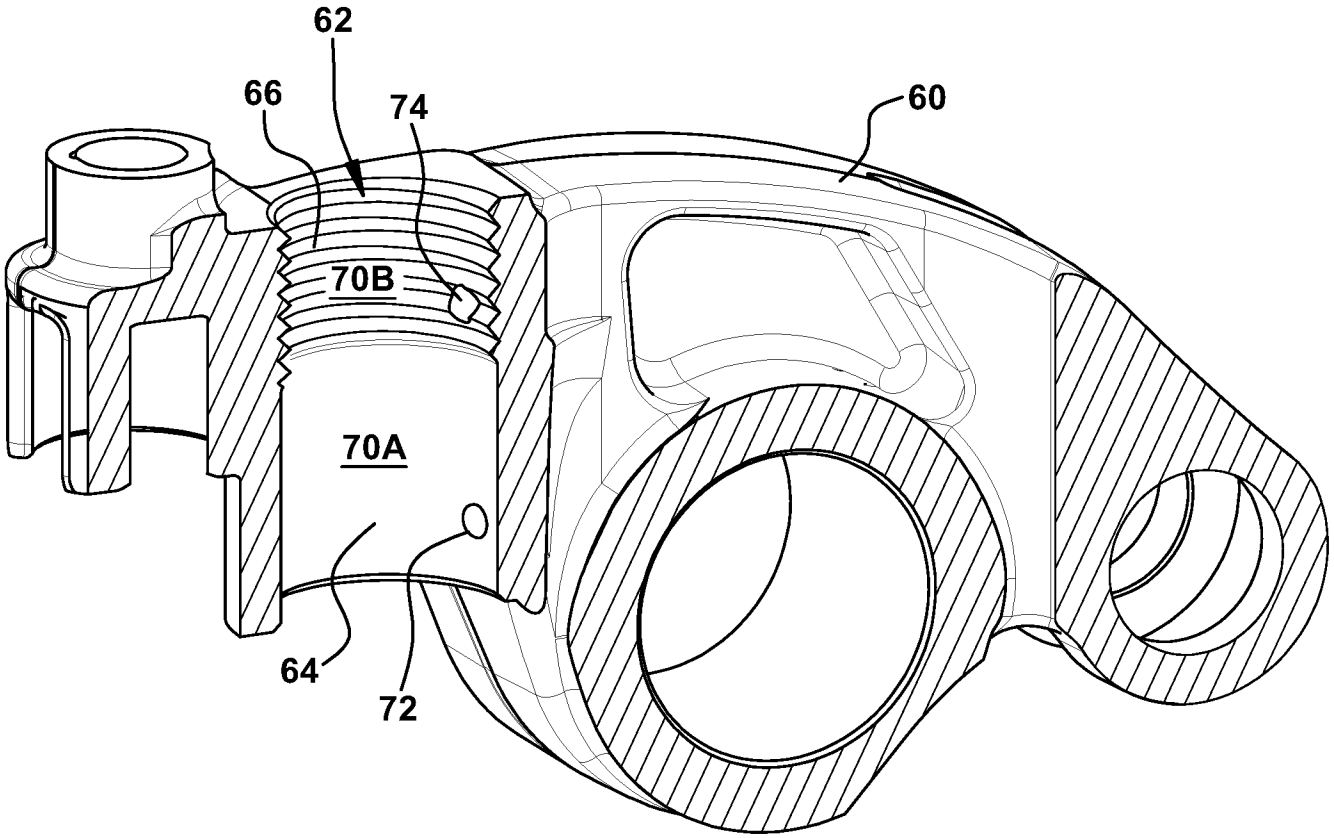
FIG. 2 is section view of a rocker arm of the rocker arm assembly of FIG. 1 taken along line 2-2.

Referring to FIG. 2, the rocker arm 60 includes a hole 62 that is dimensioned to receive the capsule assembly 100. The hole 62 includes a lower portion 64 that defines a lower chamber 70A and an upper threaded portion 66 that defines an upper chamber 70B and. A first hole 72 opens into the lower portion 64 for supplying fluid to the lower chamber 70A. A second hole 74 opens into the upper threaded portion 66 for supplying fluid to the upper chamber 70B. In the embodiment illustrated, there is one first hole 72 and one second hole 74. It is contemplated that additional first holes 72 and second holes 74 may fluidly connect to the lower chamber 70A and the upper chamber 70B, respectively.

It is contemplated that the fluid supplied to the second hole 74 may be selectively controlled. The second hole 74 may be selectively fluidly connected to a source of pressurized fluid so that pressurized fluid is supplied to the upper chamber 70B when desired. In the embodiment illustrated, the second hole 74 is part of a lubrication channel that extends through the rocker arm 60 for fluidly connecting the shaft 56 to the upper chamber 70B to supply controlled pressurized oil to the upper chamber 70B. It is further contemplated that the fluid supplied to the first hole 72 may be fluidly connected to a source of lubrication oil. In the embodiment illustrated, the first hole 72 is part of a lubrication channel that extends through the rocker arm 60 for fluidly connecting the shaft 56 to the lower chamber 70A to supply lubrication oil to the lower chamber 70A. The first hole 72 may be connected to the source of lubrication oil that is configured to provide lubrication oil at a constant pressure during operation of the engine (not shown). It is contemplated that the pressure of the fluid supplied to the first hole 72 may be approximately equal to the pressure of the fluid that is supplied to the second hole 74.

Figure 3:
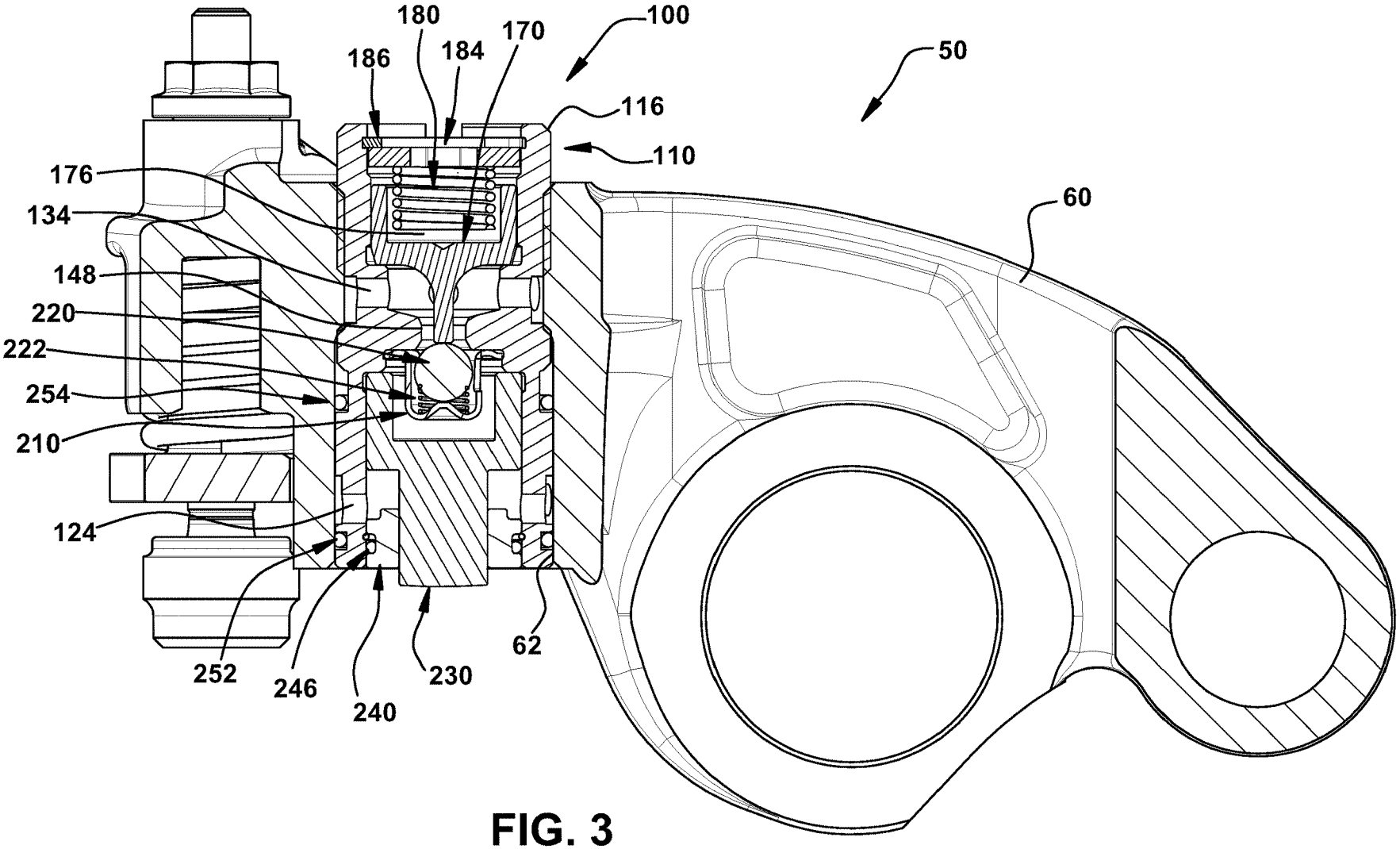
FIG. 3 is a section view of a double pressure capsule assembly in the rocker arm assembly of FIG. 1 taken along line 2-2.

Referring to FIG. 3, the double pressure capsule assembly 100 is dimensioned to be received into the hole 62. The capsule assembly 100, in general, includes a housing 110, a piston 170, a ball 220, and a plunger 230.

Figure 5:
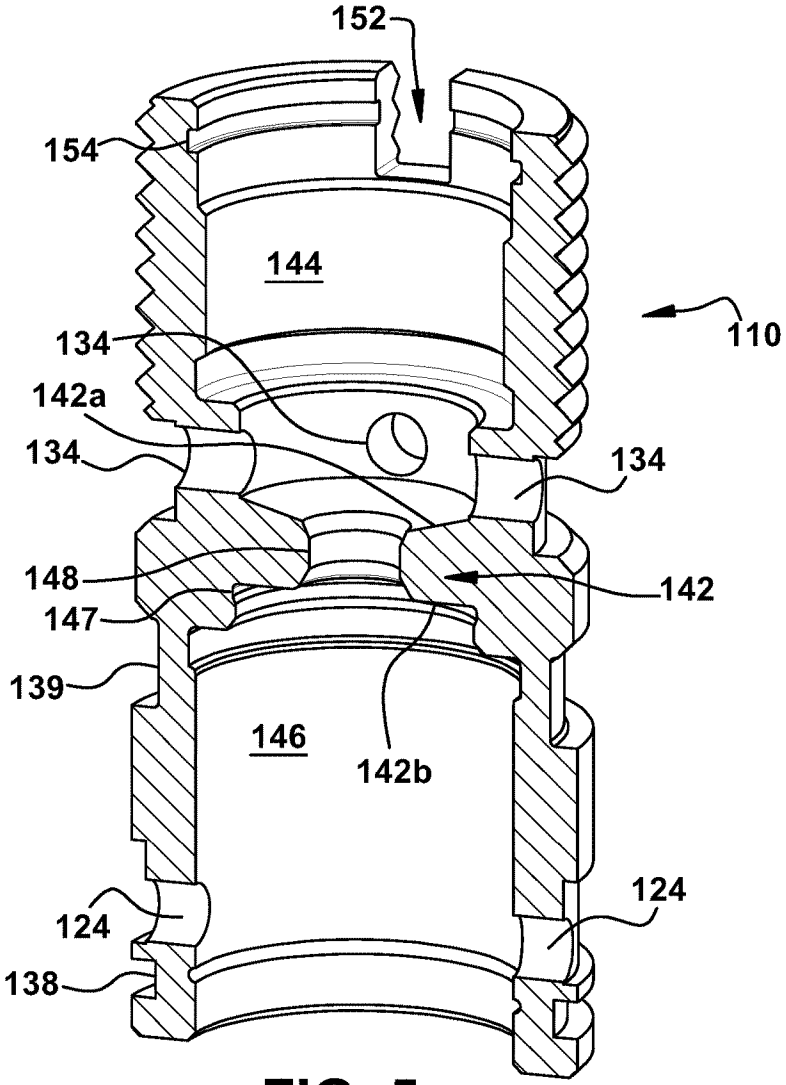
FIG. 5 is a section view taken along lines 5-5 of FIG. 4.
Figure 4:
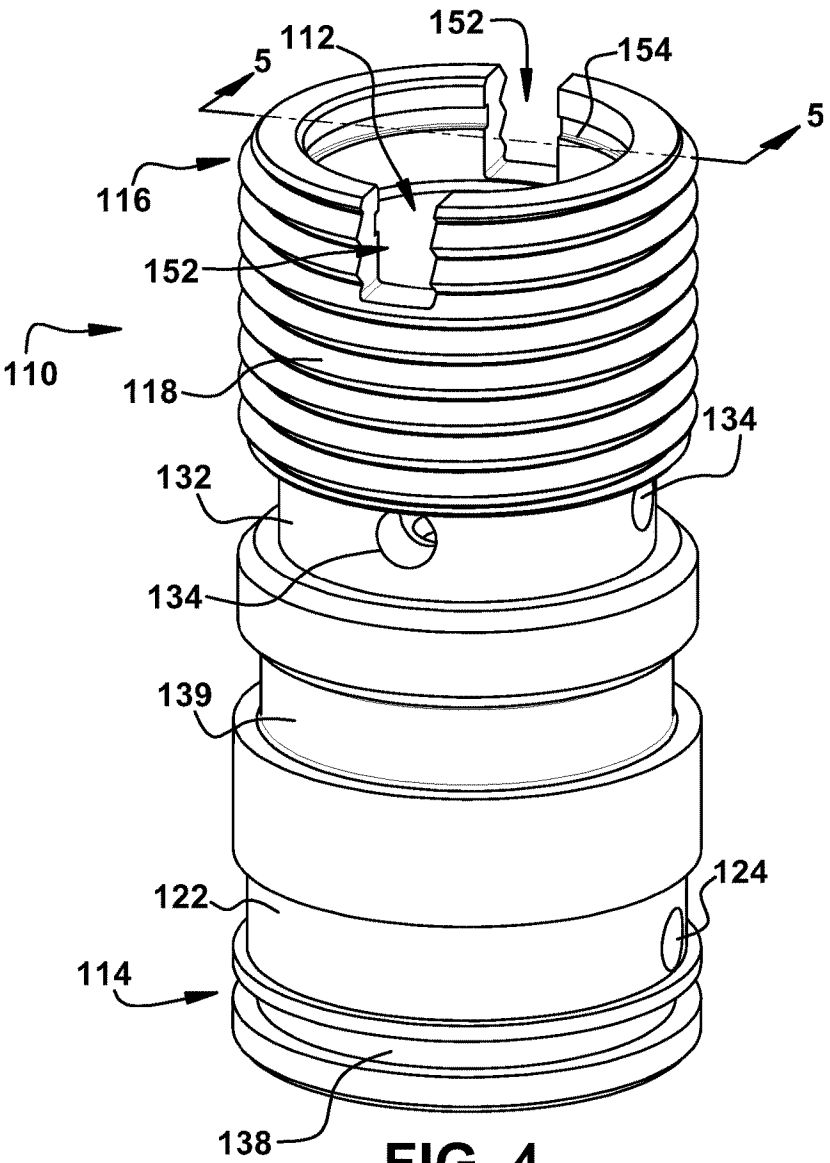
FIG. 4 is a side perspective view of a housing of a double pressure capsule assembly of FIG. 3.

Referring to FIGS. 4 and 5, the housing 110 is a generally cylindrical shaped element having an inner cavity 112, a first end 114, a second end 116. Threads 118 are formed in the outer cylindrical surface of the housing 110 near the second end 116. The threads 118 are dimensioned to engage the threads on the upper threaded portion 66 of the hole 62.

A first peripheral groove 122 is formed in the outer cylindrical surface of the housing 110 near the first end 114. A first plurality of holes 124 are positioned to have one opening in the first peripheral groove 122 and a second opening in the inner cavity 112 to provide fluid communication between the first peripheral groove 122 and the inner cavity 112 of the housing 110. In the embodiment shown, there are four equally spaced holes 124 that extend radially through the housing 110 between the first peripheral groove 122 and the inner cavity 112.

A second peripheral groove 132 is formed in the outer cylinder surface of the housing 110 adjacent the threads 118. A second plurality of holes 134 are positioned to have one opening in the second peripheral groove 132 and another opening in the inner cavity 112 to provide fluid communication between the second peripheral groove 132 and the inner cavity 112 of the housing 110. In the embodiment shown, there are four equally-spaced holes 134 that extend radially through the housing 110 between the second peripheral groove 132 and the inner cavity 112.

A first annular groove 138 is formed in the outer cylindrical surface of the housing 110 near the first end 114. The first annular groove 138 is positioned between the first end 114 and the first peripheral groove 122. The first annular groove 138 is dimensioned to receive a first o-ring 252 (FIG. 3), as described in detail below.

A second annular groove 139 is formed in the outer cylindrical surface of the housing 110. The second annular groove 139 is positioned between the first peripheral groove 122 and the second peripheral groove 132. The second annular groove 139 is dimensioned to receive a second o-ring 254 (FIG. 3), as described in detail below.

Referring to FIG. 5, an inner wall 142 divides the inner cavity 112 of the housing 110 into a first compartment 144 and a second compartment 146. The inner wall 142 has a first surface 142*a* facing the first compartment 144 and a second surface 142*b* facing the second compartment 146. A hole 148 extends through the inner wall 142. A portion of the second surface 142*b* around the hole 148 is chamfered to define a seat for the ball 220 (FIG. 3), as described in detail below.

Notches 152 are formed in the second end 116 of the housing 110. In the embodiment illustrated, there are two diametrically opposed notches 152.

Figure 6:
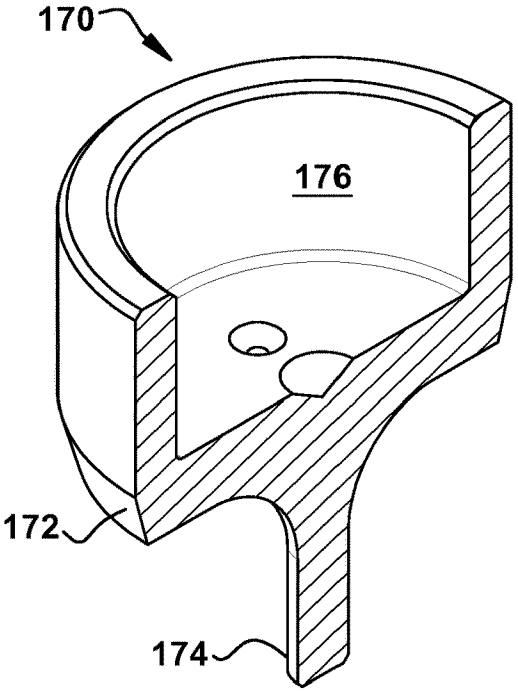
FIG. 6 is a section view of a piston of the double pressure capsule assembly of FIG. 3.

Referring to FIGS. 3 and 6, the piston 170 is dimensioned to slidingly move in the first compartment 144 of the housing 110. The piston 170 has a cup-shaped body portion 172 with a pin portion 174 protruding from a closed end of the body portion 172. The body portion 172 defines a cavity 176 for receiving a spring 180 (FIG. 3).

Referring to FIG. 3, the spring 180 is a compression element that is configured to be received in the cavity 176 of the piston 170. The spring 180 has a first end that engages a bottom of the cavity 176 and a second end that engages a plate 184 such that the spring 180 is compressed between the piston 170 and the plate 184.

Figure 9:
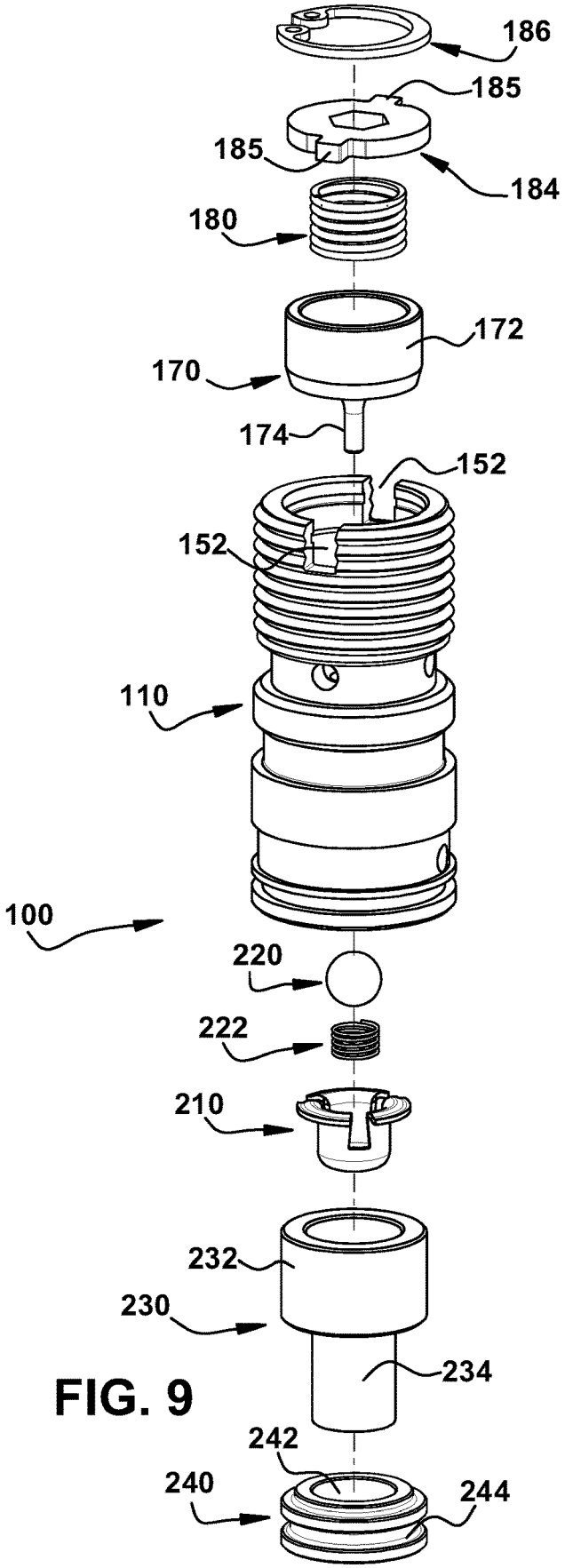
FIG. 9 is an exploded view of the double pressure capsule assembly of FIG. 3.

The plate 184 is dimensioned to be received the first compartment 144 of the housing 110 between the piston 170 and the first end 114 of the housing 110. Referring to FIG. 9, the plate 184 includes two outwardly extending tabs 185 that are dimensioned and positioned to be received into the notches 152 on the first end 114 of the housing 110.

Referring to FIGS. 3 and 9, a retention ring 186 is provided for retaining the piston 170, the spring 180 and the plate 184 in the first compartment 144. The retention ring 186 is dimensioned to be received into an inner groove 154 (FIGS. 4 and 5) formed in an inner wall of the first compartment 144 of the housing 110. The inner groove 154 is positioned such that, when assembled, the spring 180 is compressed between the piston 170 and the plate 184 to bias the piston 170 to a lowered position, as illustrated in FIG. 3.

Figure 7:
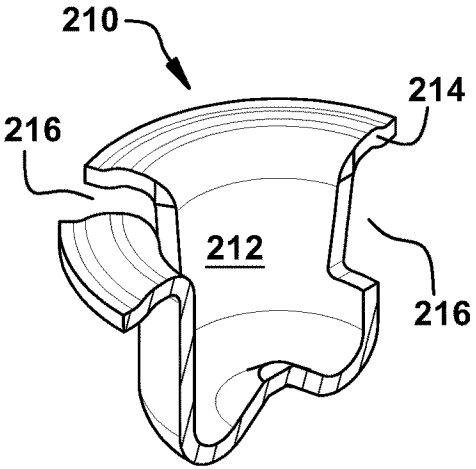
FIG. 7 is a section view of a holder of the double pressure capsule assembly of FIG. 3.

Referring to FIGS. 3 and 7, a holder 210 retains and positions the ball 220 and a spring 222 in the second compartment 146 of the housing 110. Referring to FIG. 7, the holder 210 is a cup-shaped element having a central cavity 212 and an outwardly extending peripheral flange 214 at an open end thereof. A plurality of openings 216 are formed in the side wall of the holder 210. The ball 220 and the spring 222 are dimensioned to be received into the central cavity 212 of the holder 210.

Referring to FIG. 5, a portion of the wall of the second compartment 146 adjacent the inner wall 142 is contoured to define a groove 147. The groove 147 is dimensioned to receive the outwardly extending peripheral flange 214 of the holder 210 to retain the holder 210 at a position adjacent the inner wall 142.

Referring to FIG. 3, when the holder 210, the ball 220 and the spring 222 are assembled into the second compartment 146, the spring 222 is compressed between the holder 210 and the ball 220 to bias the ball 220 towards the hole 148 in the inner wall 142. The ball 220 is dimensioned to be larger than the hole 148 such that when the ball 220 contacts the inner wall 142, the ball 220 closes the hole 148.

Figure 8:
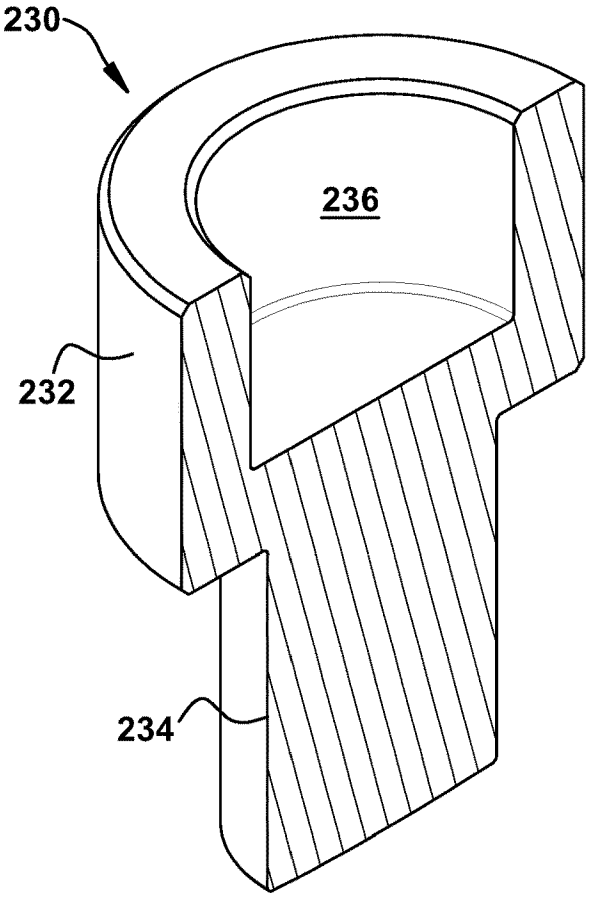
FIG. 8 is a section view of a plunger of the double pressure capsule assembly of FIG. 3.

The plunger 230 is dimensioned to slide within the second compartment 146. Referring to FIG. 8, the plunger 230 includes a cup-shaped body portion 232 and a stem 234 that extends from the closed end of the plunger 230. A cavity 236 is formed in the body portion 232 and is dimensioned to receive the holder 210 when assembled.

Referring to FIGS. 3 and 9, a guide element 240 is positioned in the second compartment 146 to close a lower open end thereof. The guide element 240 includes a central hole 242 that is dimensioned to allow the stem 234 of the plunger 230 to slide therein. An o-ring groove 244 is formed in an outer cylinder surface of the guide element 240 for allowing the guide element 240 to seal the second compartment 146.

Referring to FIGS. 3 and 9, the double pressure capsule assembly 100 may be assembled by placing the ball 220, the spring 222 and the holder 210 into the second compartment 146 of the housing 110. The spring 222 is first placed into the cavity 176 of the piston 170 and then the ball 220 is placed on the spring 222. The holder 210 is then inserted into the open end of the second compartment 146 such that the peripheral flange 214 is received into the groove 147 adjacent the inner wall 142. The groove 147 is dimensioned to retain the holder 210 in the second compartment 146. The spring 222 is dimensioned such that it is compressed between the ball 220 and the holder 210. The spring 222 thereby biases the ball 220 into contact with the hole 148 in the inner wall 142 to fluidly seal the hole 148.

The plunger 230 is oriented such that the body portion 232 faces the second compartment 146 and the stem 234 extends away from the second compartment 146. As the plunger 230 is inserted into the second compartment 146, the body portion 232 slides in the second compartment 146. An o-ring 246 is placed in the o-ring groove 244 of the guide element 240 and the guide element 240 is inserted into the second compartment 146 so that the stem 234 extends through the central hole 242 of the guide element 240. The guide element 240 is inserted into the second compartment 146 until the o-ring 246 sealingly engages the side wall of the second compartment 146.

The piston 170 is oriented so that the pin portion 174 faces the first compartment 144. As the piston 170 is inserted into the first compartment 144 (i.e., the pin portion 174 is inserted first then the body portion 172), the piston 170 slides within the first compartment 144. The spring 180 is then placed into the cavity 176 of the piston 170. The plate 184 is oriented such that the tabs 185 align the notches 152 in the housing 110. As the plate 184 is pressed into the first compartment 144, the spring 180 is compressed between the piston 170 and the plate 184. The spring 180 is dimensioned such that it biases the pin portion 174 of the piston 170 through the hole 148 and into engagement with the ball 220. The spring 180 and the piston 170 are dimensioned so that when the plate 184 is positioned so that the retention ring 186 may be placed in the inner groove 154, the piston 170 moves the ball 220 away from the hole 148 in the inner wall 142. The retention ring 186 is then placed in the inner groove 154 to secure the piston in the first compartment 144.

Figure 10B:
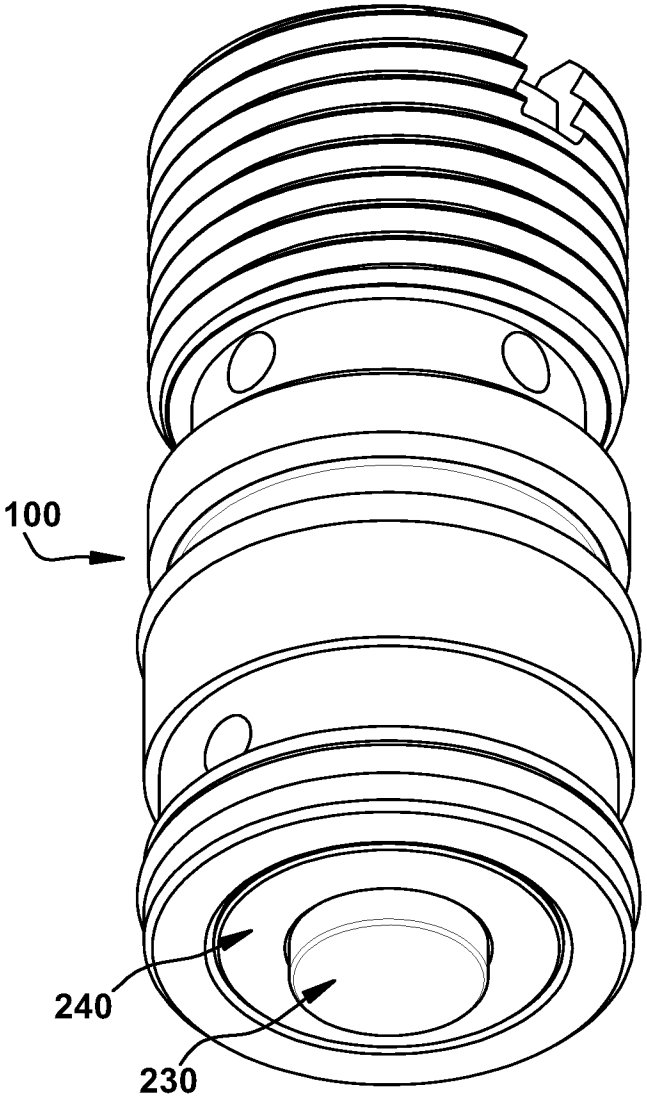
FIG. 10B is a bottom perspective view of the double pressure capsule assembly of FIG. 3.
Figure 10A:
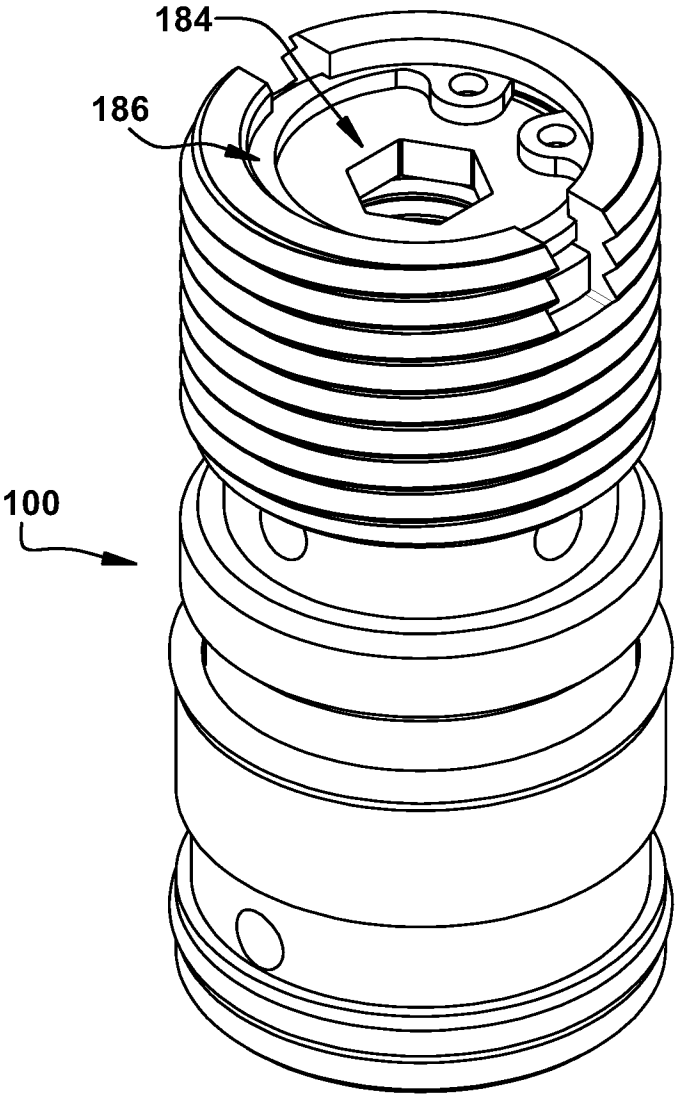
FIG. 10A is a top perspective view of the double pressure capsule assembly of FIG. 3.

Referring to FIGS. 10A and 10B, when assembled, the foregoing components are movably retained within the inner cavity 112 of the housing 110. The stem 234 of the plunger 230 protrudes out of a lower end of the capsule assembly 100 through the guide element 240. On the opposite end, the retention ring 186 retains components in the first compartment 144 of the capsule assembly 100.

Figure 11:
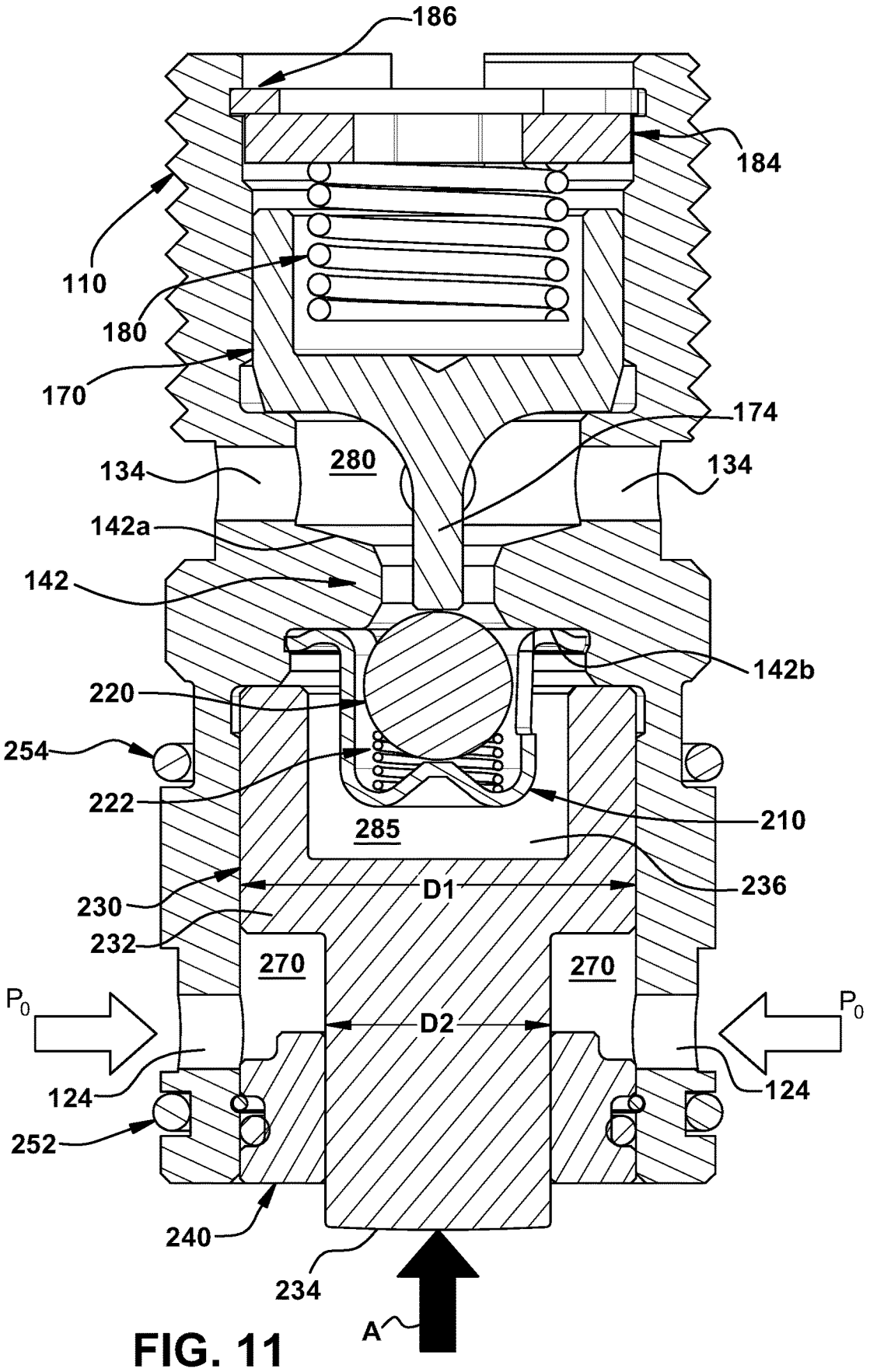
FIG. 11 is a section view taken along line 2-2 of FIG. 1 showing a piston in a first position, a ball in an open position and a plunger in a deactivated position.

Referring to FIG. 11, when assembled, the lower surface of the body portion 232 of the plunger 230, the walls of the second compartment 146 and the guide element 240 define a first fluid chamber 270 of the double pressure capsule assembly 100. The first fluid chamber 270 fluidly communicates with the first plurality of holes 124 in the housing 110. The piston 170 and the first surface 142*a* of the inner wall 142 define a first sub-chamber 280. The cavity 236 of the plunger 230 and the second surface 142*b* of the inner wall 142 define a second sub-chamber 285. The first sub-chamber 280 and the second sub-chamber 285 both fluidly communicate with the second plurality of holes 134 in the housing 110 and together define a second fluid chamber.

A surface area of the body portion 232 of the plunger 230 that defines a boundary of the first fluid chamber 270 (i.e., D1 minus D2 in FIG. 11), is smaller than the surface area of the body portion 232 that defines a boundary of the second sub-chamber 285 (i.e., D1 in FIG. 11). As described in detail below, when equal pressure is applied to the first fluid chamber 270 and the second sub-chamber 285, the plunger 230 will move away from the inner wall 142 toward the guide element 240.

Referring to FIG. 3, the first o-ring 252 is placed in the first annular groove 138 and the second o-ring 254 is placed in the second annular groove 139. The assembled double pressure capsule assembly 100 is then inserted into the hole 62 (FIG. 2) of the rocker arm assembly 50. The capsule assembly 100 is inserted into the hole 62 (FIG. 2) with the first end 114 being inserted first. As the capsule assembly 100 is inserted, the threads 118 on the housing 110 engage the upper threaded portion 66 (FIG. 2) and the capsule assembly 100 is threaded into the hole 62 to be secured therein. Once threaded into the hole 62, the capsule assembly 100 is oriented such that the first peripheral groove 122 and the first plurality of holes 124 are in registry with the first hole 72 (FIG. 2) and the second peripheral groove 132 and the second plurality of holes 134 are in registry with the second hole 74 (FIG. 2). In this orientation, fluid supplied to the first hole 72 flows into the first fluid chamber 270 and fluid supplied to the second hole 74 flows into the first sub-chamber 280 and the second sub-chamber 285. Optionally, a nut (not shown) may be threaded onto the capsule assembly 100 to further retain the capsule assembly 100 in the hole 62. The first o-ring 252 and the second o-ring 254 form seals with the hole 62 for hindering the release of fluid from the capsule assembly 100.

The capsule assembly 100 will now be described with relation to the operation of the same. For clarity, in FIGS. 11-13, the capsule assembly 100 is shown outside of the rocker arm assembly 10. During normal operation, lubrication fluid is provided via the first holes 72 (FIG. 2) to the first plurality of holes 124 and the first fluid chamber 270 at a pressure $P_0$. The first sub-chamber 280 and the second sub-chamber 285 are at atmospheric pressure. The pressure of the lubrication fluid is sufficient to move the plunger 230 to the deactivated position, as illustrated in FIG. 11. In this position, the pressure $P_0$ of the fluid causes the plunger 230 to be moved to the deactivated position, also referred to as a raised position, because the plunger 230 is not in engagement with the valve 52 (FIG. 1). See arrow "A" in FIG. 11. The spring 180 biases the piston 170 to a first position wherein the pin portion 174 engages the ball 220 to move it out of engagement with the inner wall 142. In the position, the ball 220 is in an open position and both the first sub-chamber 280 and the second sub-chamber 285 are at the same pressure, i.e., atmospheric pressure.

Figure 12:
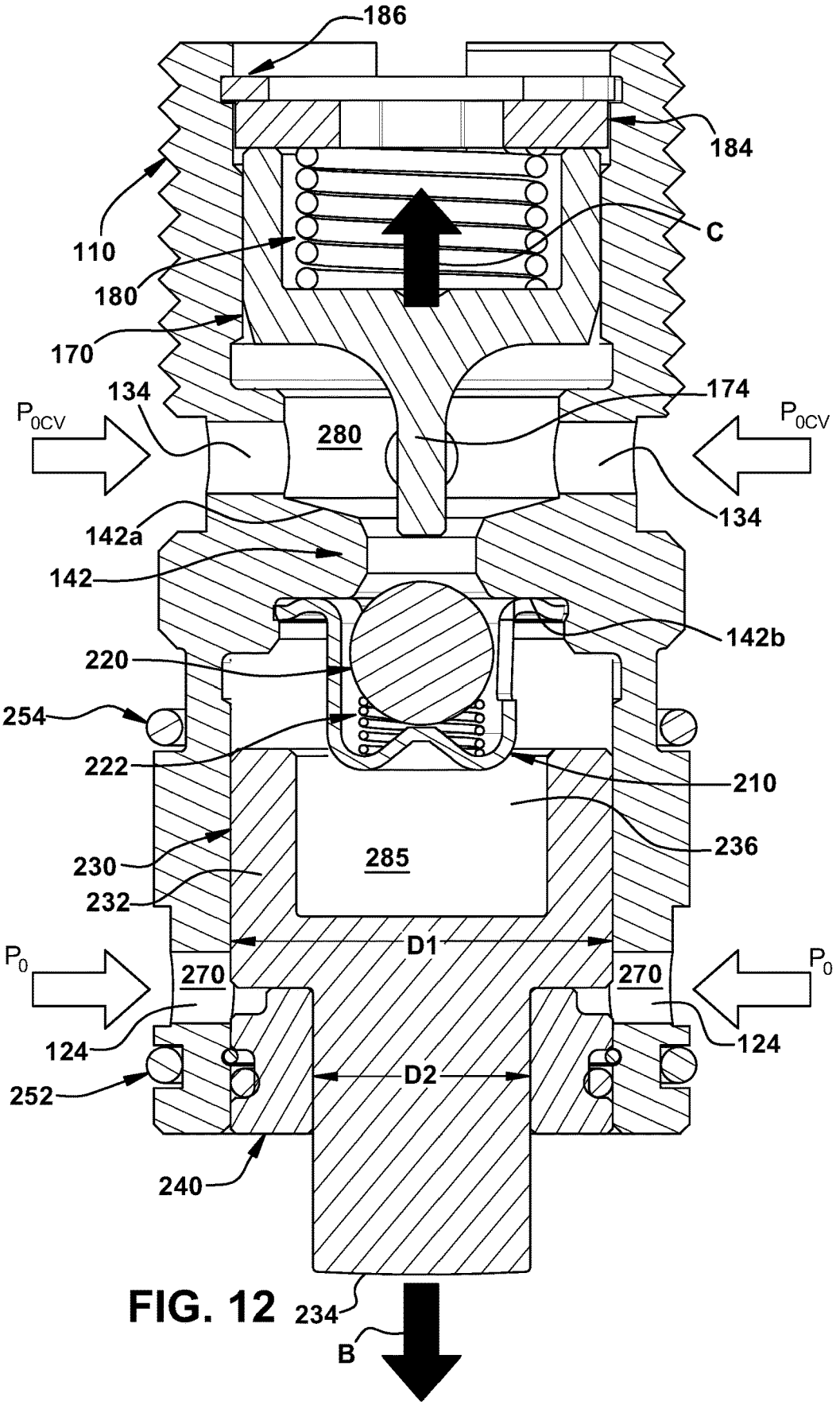
FIG. 12 is a section view taken along line 2-2 of FIG. 1 showing a piston in a second position, a ball in an open position and a plunger in an activated position.

Referring to FIG. 12, when it is desired to actuate the plunger 230, e.g., for an engine brake function, pressurized fluid having a pressure $P_{OCV}$ is provided to the first sub-chamber 280 and the second sub-chamber 285 via the second holes 74 (FIG. 1) and the second plurality of holes 134. As the pressurized fluid flows from the first sub-chamber 280 to the second sub-chamber 285, the pressure of the flowing fluid maintains the ball 220 out of engagement with the inner wall 142, i.e. in the open position. It is contemplated that the pressure $P_0$ in the first fluid chamber 270 may be approximately equal to the pressure $P_{OCV}$ in the first sub-chamber 280 and the second sub-chamber 285. Because the surface area of the plunger 230 defining a boundary of the first fluid chamber 270 (i.e., D1 minus D2) is less than the surface area of the plunger 230 defining a boundary of the second sub-chamber 285 (i.e., D1), there is an unbalanced force on the plunger 230 that causes the plunger 230 to move away from the inner wall 142 toward the guide element 240. The plunger 230 moves to an activated position. See arrow "B". In addition, the piston 170 moves from a second position wherein the pin portion 174 no longer engages the ball 220. See arrow "C".

Figure 13:
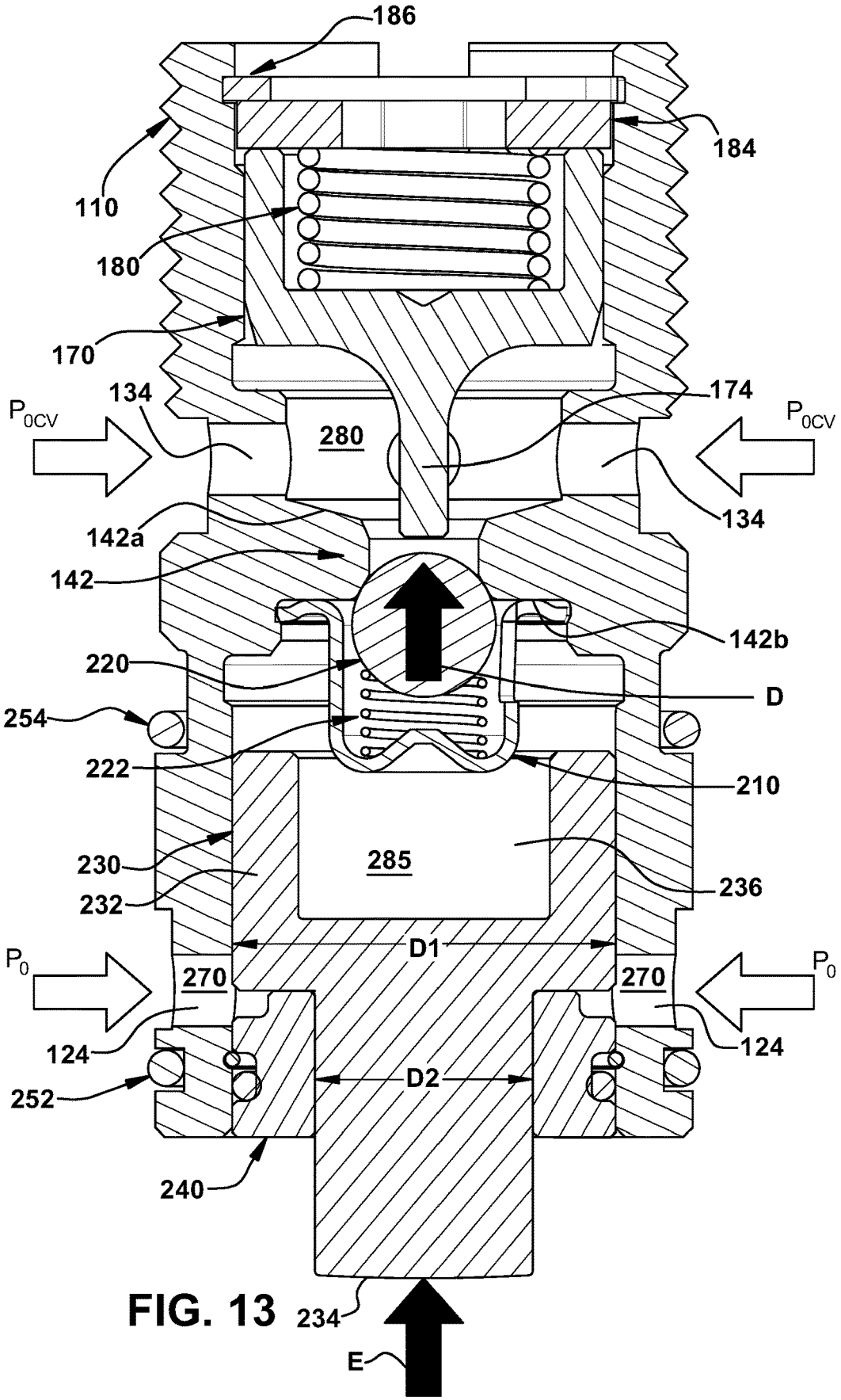
FIG. 13 is a section view taken along line 2-2 of FIG. 1 showing a piston in a second position, a ball in a closed position and a plunger in an activated position.

Referring to FIG. 13, with the plunger 230 in the activated position, movement of rocker arm assembly 50 towards the valve 52 is resisted by a valve spring 53 (FIG. 1) that applies a resistance force to the plunger 230 (via the valve 52) in the direction of the arrow "E" in FIG. 13. This resistance force causes the plunger 230 to move slightly toward the inner wall 142. This movement results in a sudden increase in pressure in the second sub-chamber 285 that causes the ball 220 to move toward the inner wall 142 in the direction of arrow "D", i.e., to the closed position. The ball 220 seats against the inner wall 142 and closes the hole 148 in the inner wall 142. With the hole 148 closed, pressurized fluid is "locked" into the second sub-chamber 285 and the entire capsule assembly 100 acts as a solid component so that the force from the rocker arm assembly 50 may be transferred through the capsule assembly 100 to the valve 52 to move the valve 52 to the desired position Once the resistance from the spring is remove, e.g., when the rocker arm assembly 50 pivots to a position that does not apply a force to the valve 52, the resistance force from the spring on the valve 52 is removed and the pressure in the second sub-chamber 285 is released. The fluid in the second sub-chamber 285 leaks into the surrounding environment as the plunger 230 returns to the deactivated position and the piston 170 returns to the first position in contact with the ball 220, as illustrated in FIG. 11.

The double pressure capsule assembly 100, thereby provides an apparatus that controls the actuation of a valve. The capsule assembly 100 provides a plunger 230 that is not in contact with the valve 52 during periods when the valve 52 is not to be actuated. The plunger 230 engages the valve 52 only when actuation of the valve 52 is desired.

Figure 14:
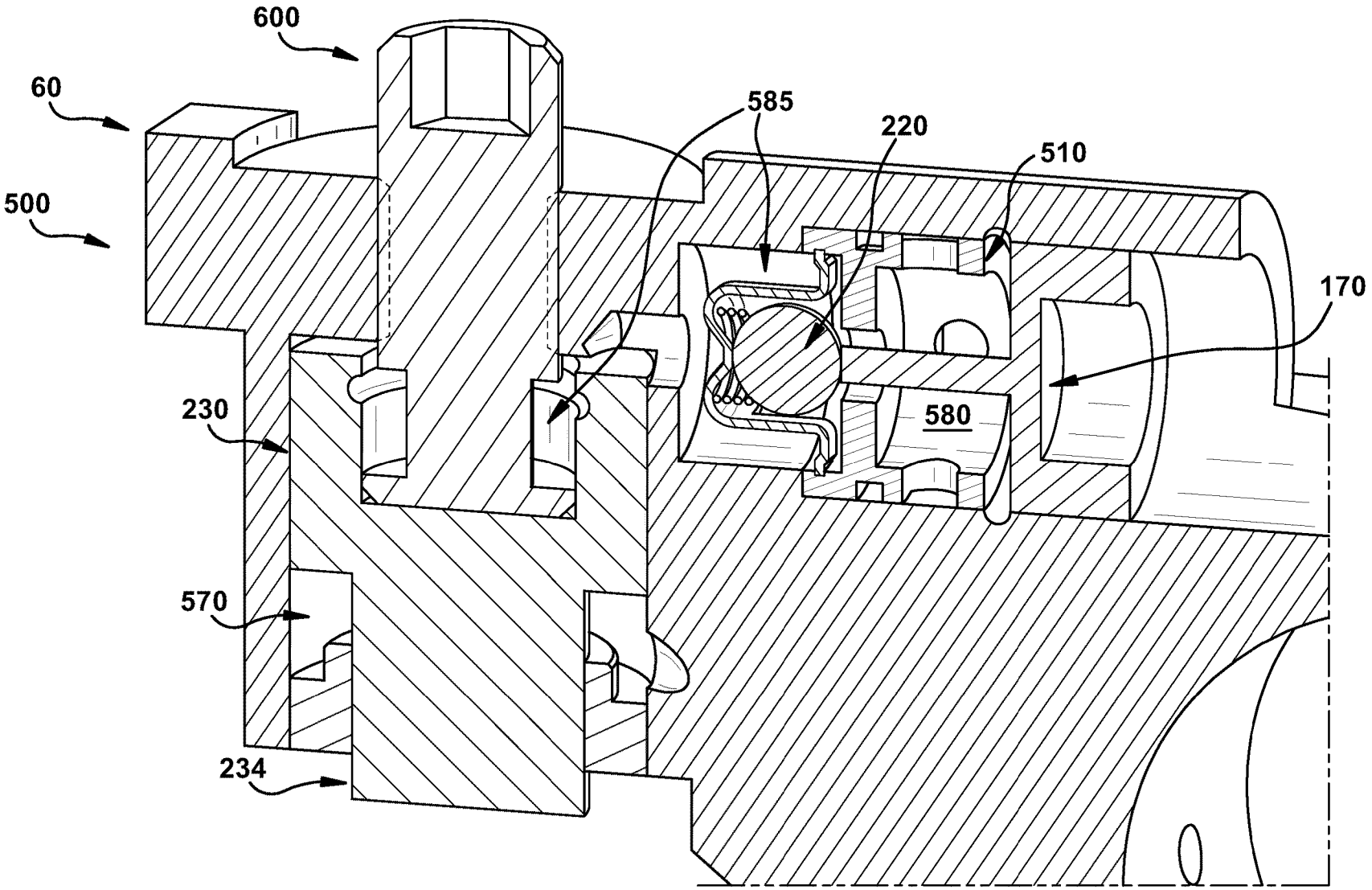
FIG. 14 is a section view of an alternative embodiment of a double pressure capsule assembly.

In an alternative embodiment, illustrated in FIG. 14, a double pressure capsule assembly 500 is provided. The components of the capsule assembly 500 are similar to those in the capsule assembly 100 and are not described in detail for brevity. The components for the capsule assembly 500 are referred to with reference numbers that are similar to those used for the capsule assembly 100. Instead of having the housing 110, the capsule assembly 500 may be disposed directly in various passages in the rocker arm assembly 50. Further, an inner wall of the capsule assembly 500 against which the ball 220 seals, is defined by an insert 510.

The capsule assembly 500 includes a first sub-chamber 580 that is oriented perpendicular to a first fluid chamber 570. The second sub-chamber 585 extends over two locations, one adjacent the first sub-chamber 580 and the other adjacent the first fluid chamber 570. This configuration finds particular application in rocker arm assemblies where there is insufficient height for the first sub-chamber 580, the second sub-chamber 585 and the first fluid chamber 570 to be aligned with each other along a common axis, as provided in the capsule assembly 100. The operation of the capsule assembly 500 is similar to that of the capsule assembly 100 is not repeated herein for brevity.

It is contemplated that other embodiments of the capsule assembly 500 are possible where the first fluid chamber 570 and the first sub-chamber 580 are oriented relative to each other at an angle other than 90 degrees. For example, it is contemplated that the first fluid chamber 570 and the first sub-chamber 580 may be side-by-side and connected via a cross hole (not shown).

The capsule assembly 500 finds particular application when a latch adjustment pin 600 is needed to adjust the valve latch. The latch adjustment pin 600 may be configured to axially align with the first fluid chamber 570 and thread into the rocker arm 60. The position of the latch adjustment pin 600 may be adjusted as desired by the user to define a stop that limits the distance that the plunger 230 may be displaced.

In the embodiments described above, the double pressure capsule assembly 100, 500, in general, includes a first fluid chamber that is supplied with fluid that at a constant pressure during the operation of the engine. A second fluid chamber is provided that is selectively supplied with fluid at the same pressure. A check valve is disposed within the second fluid chamber for selectively dividing the second fluid chamber into a first sub-chamber and a second sub-chamber. The first sub-chamber is defined between the check valve and the piston and the second sub-chamber is defined between the check valve and a plunger. The piston is provided in the second fluid chamber for maintaining the check valve open such that the first sub-chamber and the second sub-chamber are in fluid communication with each other. During operation of the engine, the first fluid chamber is supplied with pressurized fluid and the second fluid chamber, i.e., both the first sub-chamber and the second sub-chamber, are at atmospheric pressure. In this condition, the plunger is displaced by the fluid pressure in the first fluid chamber toward the second fluid chamber. In this position, the plunger is not in contact with an adjacent valve, i.e. the plunger is deactivated.

When it is desired to move the plunger into contact with the valve, i.e., activated, pressurized fluid is supplied to the second fluid chamber to force the plunger toward the first fluid chamber and into contact with the valve stem. This movement is accomplished by a difference in the surface area of the plunger that is acted on by the fluid in the first fluid chamber and the surface area of the plunger that is acted on by the fluid in the second fluid sub-chamber. The fluid supplied to the second fluid chamber also moves the piston out of contact with the check valve, i.e., to a second position.

As the rocker arm assembly pivots toward the vale to actuate it, the valve supplies a resistance force to the plunger via a valve spring. This force is sufficient to cause a sudden increase in the pressure of the fluid in the second sub-chamber thereby causing the check valve to move to the closed position and fluidly isolate the first sub-chamber from the second sub-chamber. Because the second sub-chamber is filled with an incompressible fluid, the closing of the check valve makes the capsule "firm," i.e., the capsule is able to transmit force from the rocker arm assembly to the valve. The valve is then actuated to the desired position.

Once the rocker arm assembly is moved to a position such that movement of the valve is no longer desired, the valve comes out of contact with the plunger and the high pressure fluid in the second sub-chamber is released to the surrounding environment. The fluid pressure in the first fluid chamber then moves the plunger to the raised position. The fluid pressure in the second fluid chamber is also eliminated so the piston may return to its original position of engaging the check valve.

The double pressure capsule assembly provides a compact apparatus for selectively actuating a valve for a desired function, e.g., engine braking. It is contemplated that the double pressure capsule assembly may find application in other apparatuses where it is desirable to selectively actuate a valve.

It will be apparent to those skilled in the art that various modifications and variations can be made without departing from the spirit and scope of the claimed invention.

What is claimed is:

1. A double pressure capsule assembly for selectively actuating a valve, the capsule assembly comprising:

a plunger movable within a body between a deactivated position wherein the plunger is disengaged from the valve and an activated position wherein the plunger engages the valve, the plunger dividing the body into a first chamber fluidly connected to a first source of fluid at a first pressure and a second chamber selectively connected to a second source of fluid at the first pressure, the plunger having a first surface area bordering the first chamber and a second surface area bordering the second chamber, wherein the first surface area is less than the second surface area;

a check valve disposed within the second chamber for selectively dividing the second chamber into a first sub-chamber and a second sub-chamber, the check valve have an open position wherein the first sub-chamber and the second sub-chamber are fluidly connected to each other and a closed position wherein the first sub-chamber and the second sub-chamber are fluidly isolated from each other; and a piston disposed in the second chamber, the piston movable between a first position wherein the piston engages the check valve and moves the check valve to the open position and a second position wherein the piston is disengaged from the check valve.

2. The double pressure capsule assembly of claim 1, wherein the body is a housing that is insertable into a rocker arm.

3. The double pressure capsule assembly of claim 2, wherein the housing is threaded into the rocker arm.

4. The double pressure capsule assembly of claim 2, wherein the housing includes an inner wall between the first sub-chamber and the second sub-chamber, the check valve configured to selective close a hole extending through the inner wall.

5. The double pressure capsule assembly of claim 1, wherein the body includes first holes for fluidly connecting the first chamber to the first source of fluid and second holes for fluidly connecting the second chamber to the second source of fluid.

6. The double pressure capsule assembly of claim 1, wherein the check valve comprises:

a ball that selectively engages a hole fluidly connecting the first sub-chamber and the second sub-chamber, the closed position of the check valve corresponding to the ball closing the hole and the open position of the check valve corresponding to the ball being spaced from the hole.

7. The double pressure capsule assembly of claim 6, further comprising:

a spring for biasing the ball into engagement with the hole; and a holder for receiving the ball and the spring wherein the spring is compressed between the holder and the ball.

8. The double pressure capsule assembly of claim 6, wherein the hole is formed in a wall that borders both the first sub-chamber and the second sub-chamber.

9. The double pressure capsule assembly of claim 1, further comprising a spring for biasing the piston to the first position.

10. The double pressure capsule assembly of claim 1, further comprising a seal element for closing an open end of the body, wherein a portion of the plunger extends through the seal element to a surrounding environment.

11. The double pressure capsule assembly of claim 1, wherein the piston includes a stem configured to engage the check valve.

12. The double pressure capsule assembly of claim 1, wherein the double pressure capsule assembly is disposed in a rocker arm and the first chamber is fluidly connected to the first source of fluid via a first lubrication channel that extends through the rocker arm between a shaft and the first chamber and the second chamber is fluidly connected to the second source of fluid via a second lubrication channel that extends through the rocker arm between the shaft and the second chamber.

13. A double pressure capsule assembly for selectively actuating a valve, the capsule assembly comprising:

a housing removably inserted into a rocker arm, the housing defining an inner cavity extending axially therethrough, a first hole extending through a wall of the housing to fluidly connect the inner cavity to a surrounding environment and a second hole extending through the wall of the housing to fluidly connect the inner cavity to the surrounding environment, the first hole being spaced from the second hole;

a plunger movable within the housing between a deactivated position wherein the plunger is disengaged from the valve and an activated position wherein the plunger engages the valve, the plunger dividing the housing into a first chamber fluidly connected to a first source of fluid at a first pressure via the first hole and a second chamber selectively connected to a second source of fluid at the first pressure via the second hole, the plunger having a first surface area bordering the first chamber and a second surface area bordering the second chamber, wherein the first surface area is less than the second surface area;

a check valve disposed within the second chamber for selectively dividing the second chamber into a first sub-chamber and a second sub-chamber, the check valve have an open position wherein the first sub-chamber and the second sub-chamber are fluidly connected to each other and a closed position wherein the first sub-chamber and the second sub-chamber are fluidly isolated from each other, the second hole fluidly connecting the first sub-chamber to the surrounding environment; and a piston disposed in the second chamber, the piston movable between a first position wherein the piston engages the check valve and moves the check valve to the open position and a second position wherein the piston is disengaged from the check valve.

14. The double pressure capsule assembly of claim 13, wherein the housing is threaded into the rocker arm.

15. The double pressure capsule assembly of claim 13, wherein the housing includes an inner wall between the first sub-chamber and the second sub-chamber, the check valve configured to selective close a hole extending through the inner wall.

16. The double pressure capsule assembly of claim 13, wherein the check valve comprises:

a ball that selectively engages a hole fluidly connecting the first sub-chamber and the second sub-chamber, the closed position of the check valve corresponding to the ball closing the hole and the open position of the check valve corresponding to the ball being spaced from the hole.

17. The double pressure capsule assembly of claim 16, further comprising:

a spring for biasing the ball into engagement with the hole; and a holder for receiving the ball and the spring wherein the spring is compressed between the holder and the ball.

18. The double pressure capsule assembly of claim 13, further comprising a spring for biasing the piston to the first position.

19. The double pressure capsule assembly of claim 13, further comprising a seal element for closing an open end of the housing, wherein a portion of the plunger extends through the seal element to the surrounding environment.

20. The double pressure capsule assembly of claim 13, wherein the first chamber is fluidly connected to the first source of fluid via a first lubrication channel that extends through the rocker arm between a shaft and the first chamber and the second chamber is fluidly connected to the second source of fluid via a second lubrication channel that extends through the rocker arm between the shaft and the second chamber.

* * * * *